US007084830B1

(12) United States Patent
Suh

(10) Patent No.: US 7,084,830 B1
(45) Date of Patent: Aug. 1, 2006

(54) TWO-PORT ANTENNA STRUCTURE FOR MULTIPLE-INPUT MULTIPLE-OUTPUT COMMUNICATIONS

(75) Inventor: Seong-Youp Suh, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 11/070,458

(22) Filed: Mar. 2, 2005

(51) Int. Cl.
*H01Q 21/00* (2006.01)

(52) U.S. Cl. ..... 343/853; 343/893; 343/812; 343/826

(58) Field of Classification Search ..... 343/853, 343/893
See application file for complete search history.

(56) References Cited

U.S. PATENT DOCUMENTS

| | | | | |
|---|---|---|---|---|
| 3,299,430 | A * | 1/1967 | Huber et al. | 343/812 |
| 3,757,342 | A * | 9/1973 | Jasik et al. | 343/738 |
| 4,962,383 | A * | 10/1990 | Tresselt | 343/700 MS |
| 5,001,492 | A * | 3/1991 | Shapiro et al. | 343/700 MS |
| 6,744,412 | B1 * | 6/2004 | Lopez | 343/799 |
| 2005/0128161 | A1 * | 6/2005 | Kagaya et al. | 343/867 |

* cited by examiner

*Primary Examiner*—Don Wong
*Assistant Examiner*—Binh Van Ho
(74) *Attorney, Agent, or Firm*—Schwegman, Lundberg, Woessner & Kluth, P.A.

(57) ABSTRACT

A two-port antenna structure with four arms is provided on a printed circuit board.

27 Claims, 3 Drawing Sheets

MULTIPLE-INPUT MULTIPLE-OUTPUT
MULTICARRIER COMMUNICATION STATION

TWO-PORT ANTENNA STRUCTURE FOR MULTIPLE-INPUT MULTIPLE-OUTPUT COMMUNICATIONS

TECHNICAL FIELD

Some embodiments of the present invention pertain to antennas. Some embodiments pertain to multiple-input multiple-output (MIMO) communication systems, and some embodiments pertain to multicarrier and orthogonal frequency division multiplexed (OFDM) communications.

BACKGROUND

Conventional dual-polarized antennas have been difficult to implement on printed circuit boards because of the complexity of their feed structure. Some conventional feed structures employ dual coaxial cables for each pair of radiating elements requiring four coaxial cables.

DETAILED DESCRIPTION

The following description and the drawings illustrate specific embodiments of the invention sufficiently to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. Embodiments of the invention set forth in the claims encompass all available equivalents of those claims. Embodiments of the invention may be referred to, individually or collectively, herein by the term "invention" merely for convenience and without intending to limit the scope of this application to any single invention or inventive concept if more than one is in fact disclosed.

Figure 1A:
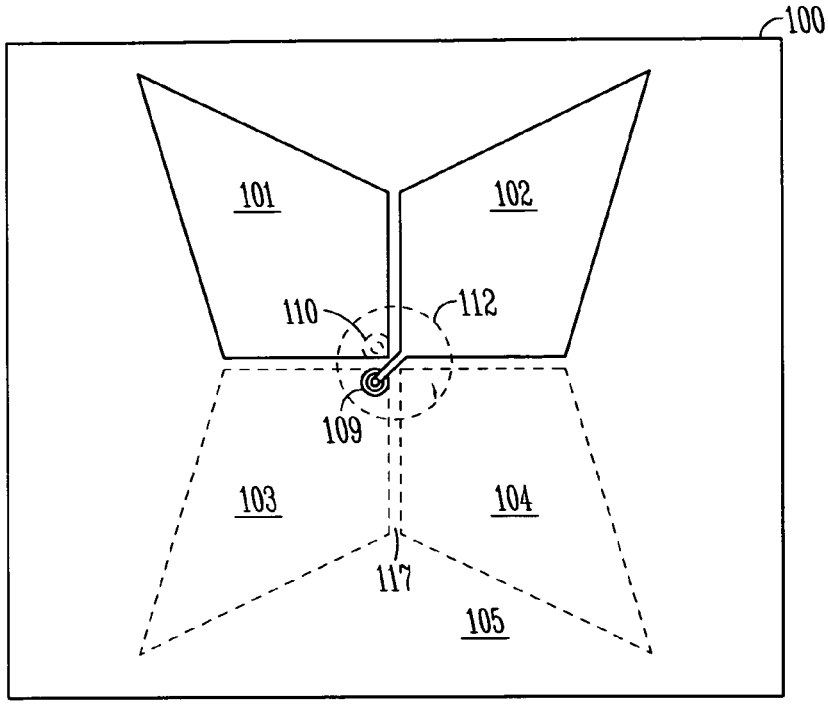
FIG. 1A illustrates a top view of an antenna structure in accordance with some embodiments of the present invention.
Figure 1B:
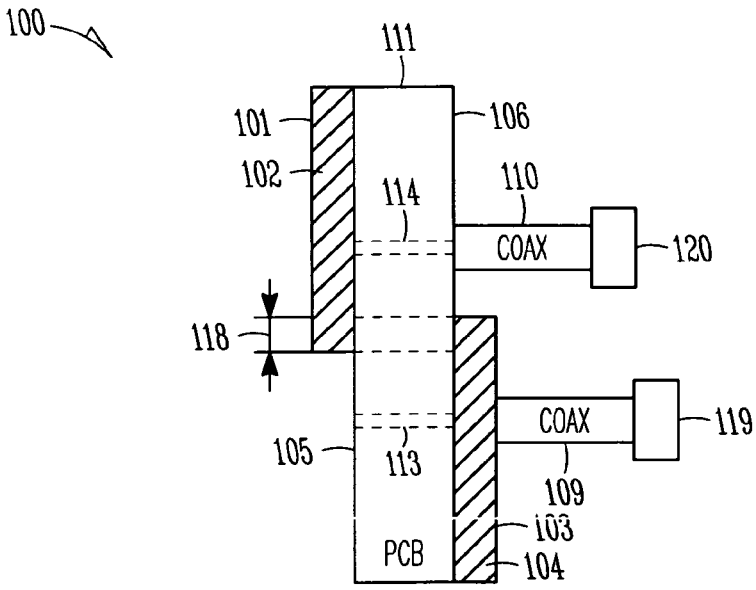
FIG. 1B illustrates a side view of the antenna structure of FIG. 1A in accordance with some embodiments of the present invention.
Figure 1C:
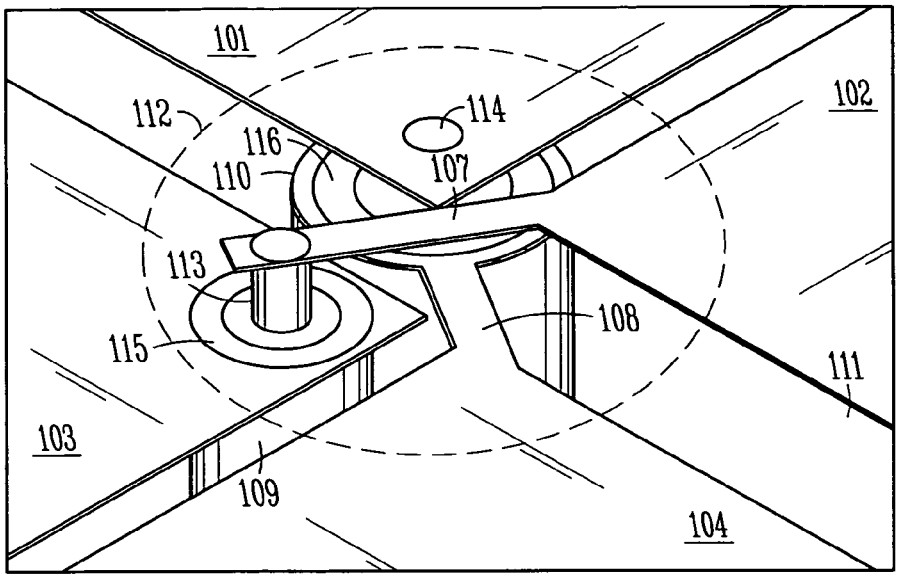
FIG. 1C illustrates a perspective view a center region of the antenna structure of FIG. 1A in accordance with some embodiments of the present invention.

FIG. 1A illustrates a top view of an antenna structure in accordance with some embodiments of the present invention. FIG. 1B illustrates a side view of the antenna structure of FIG. 1A, and FIG. 1C illustrates a perspective view a center region of the antenna structure of FIG. 1A. Antenna structure 100 employs a smart feed that may be less complex than many conventional feed structures and may eliminate some coaxial inputs/outputs associated with conventional dual-polarized antennas. In accordance with some embodiments of the present invention, antenna structure 100 may be a two-port antenna structure comprising four arms or radiating elements. As illustrated, first and second radiating elements 101 and 102 are disposed on first side 105 of insulating material 111, and third and fourth radiating elements 103 and 104 are disposed on second side 106 of insulating material 11.

Referring to FIG. 1C, first port crossover line 107 is disposed on first side 105 and coupled with second radiating element 102 extending across center region 112 of antenna structure 100. First port crossover line 107 may couple a first communication signal to second radiating element 102. In these embodiments, second port crossover line 108 is disposed on second side 106 and coupled with fourth radiating element 104 extending across center region 112 of antenna structure 100. Second port crossover line 108 may couple a second communication signal to fourth radiating element 104.

In some embodiments, first conductor 113 of first signal input 109 may extend through insulating material 111 to couple with first port crossover line 107. Second conductor 115 of first signal input 109 may couple with third radiating element 103. First conductor 114 of second signal input 110 may extend through insulating material 111 to couple with first radiating element 101. Second conductor 116 of second signal input 110 may couple with second port crossover line 108.

In some multiple-input multiple-output (MIMO) embodiments, first signal input 109 may couple the first communication signal and second signal input 110 may couple the second communication signal. In these MIMO embodiments, signal inputs 109 and 110 may carry separate and distinct communication signals for either simultaneous transmission by a MIMO transmitter or simultaneous reception by a MIMO receiver.

In some non-MIMO dual-polarized embodiments, the signals communicated by second and third radiating elements 102 and 103 may have a first polarization, and the signals communicated by first and fourth radiating elements 101 and 104 may have a second polarization. In these non-MIMO embodiments, the signal components communicated by adjacent radiating elements of structure 100 may be ninety-degrees out-of-phase with each other allowing for the transmission and/or reception of a circularly polarized signal, although the scope of the invention is not limited in this respect.

In some embodiments, first signal input 109 may comprise a first coaxial cable input, first conductor 113 of first signal input 109 may be a center conductor and second conductor 115 of first signal input 109 may be an outer ground path conductor. Second signal input 110 may comprise a second coaxial cable input, first conductor 114 of second signal input 110 may be a center conductor and second conductor 116 of second signal input 110 may be an outer ground path conductor.

In some embodiments, first and second signal inputs 109 and 110 may use RF connectors 119 and 120 for coupling with other system components. In some embodiments, antenna structure 100 may include coaxial cables having coaxial connectors at the opposite ends for connecting to other system components, although the scope of the invention is not illustrated in this respect.

In some embodiments, insulating material 111 may comprise a printed circuit board. In some embodiments, insulating material 111 may be an insulating substrate, although the scope of the invention is not limited in this respect.

In some embodiments, second and third radiating elements 102 and 103 may be diagonally or oppositely positioned with respect to each other for communicating (i.e., transmitting and/or receiving) a first communication signal. In these embodiments, first and fourth radiating elements 101 and 104 may also be diagonally or oppositely positioned with respect to each other for communicating (i.e., transmitting and/or receiving) a second communication signal. In some embodiments, the four radiating elements may be disposed on insulating material 111 in quadrature positions about center region 112 as illustrated in FIG. 1.

In some embodiments, the radiating elements may have either a spacing or an overlap therebetween that may be selected based on the desired performance characteristics of the antenna structure. FIG. 1A illustrates small spacing 117 between the antenna's radiating elements, while FIG. 1B illustrates overlap 118 between the radiating elements on opposite sides of the insulating material 111.

Although radiating elements 101, 102, 103, and 104 are illustrated as having a particular shape (e.g., somewhat like a pinwheel), the scope of the invention is not limited in this respect. Radiating elements with other shapes may also be suitable.

In some embodiments, first port crossover line 107 may extend diagonally on first side 105 across center region 112 of antenna structure 100, and second port crossover line 108 may extend diagonally on second side 106 across center region 112 of antenna structure 100. In some embodiments, first and second port crossover lines 107 and 108 may be substantially perpendicular to each other on opposite sides of insulating material 111. In some embodiments, first and second port crossover lines 107 and 108 may comprise microstrip lines, although the scope of the invention is not limited in this respect.

In some embodiments, antenna structure 100 may comprise a two-signal input antenna structure for use in a multiple-input multiple-output multicarrier communication system, such as an orthogonal frequency division multiplexed (OFDM) communication system, although the scope of the invention is not limited in this respect. In these embodiments, second and third radiating elements 102 and 103 may communicate a first multicarrier communication signal and first and fourth radiating elements 101 and 104 may communicate a second multicarrier communication signal. In some embodiments, the first and second communication signals may be transmitted concurrently and may comprise a single orthogonal frequency division multiplexed symbol, although the scope of the invention is not limited in this respect. Examples of these embodiments are described in more detail below.

In some embodiments, radiating elements 101, 102, 103 and 104, and first and second port crossover lines 107 and 108 may comprise almost any conductive material that may be disposed or printed on insulating material 111. In some embodiments, the conductive material may comprise copper, gold or silver, although the scope of the invention is not limited in this respect. In some embodiments, insulating material 111 may comprise almost any insulating substrate including many convention printed circuit board materials.

Figure 2:
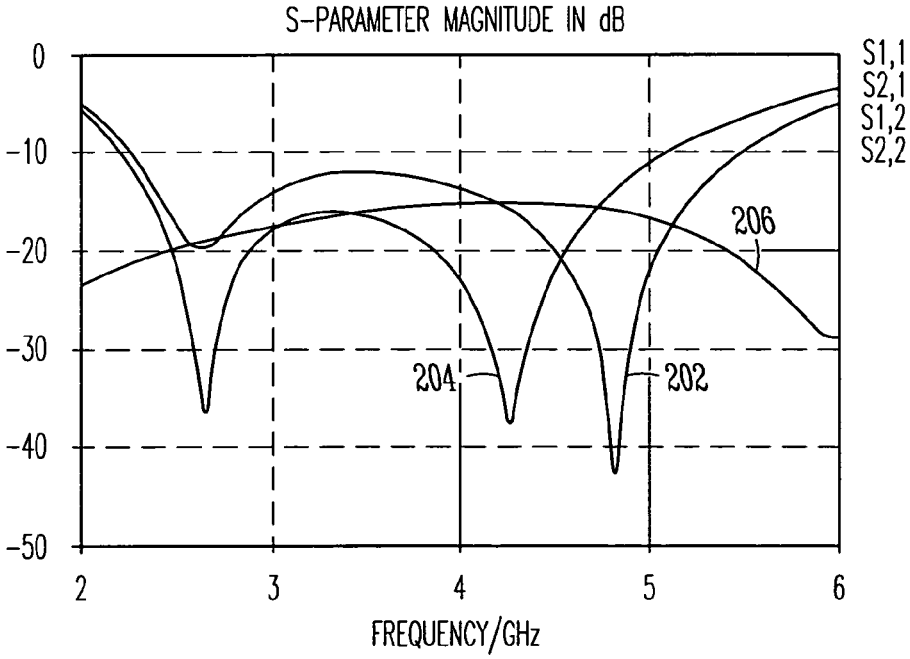
FIG. 2 illustrates S-parameter performance of an example antenna structure in accordance with some embodiments of the present invention.

FIG. 2 illustrates S-parameter performance of an example antenna structure in accordance with some embodiments of the present invention. S-parameter magnitude 202 shows an example of computed return loss (i.e., $S_{11}$) for a first signal input, such as first signal input 109 (FIG. 1A) of antenna structure 100 (FIG. 1A), and S-parameter magnitude 204 shows an example of computed return loss (i.e., $S_{22}$) for a second signal input, such as second signal input 110 (FIG. 1A) of antenna structure 100 (FIG. 1A). S-parameter magnitude 206 shows an example of either transmission or reception loss (i.e., $S_{21}$) for either the first or the second signal input of an antenna structure, such as antenna structure 100 (FIG. 1A).

Although the S-parameters illustrated in FIG. 2 illustrate the operation of antenna structure 100 (FIG. 1A) over a particular frequency range, the scope of the invention is not limited in this respect. The size and spacing of the elements of antenna 100 (FIG. 1A) may be changed and tuned to operate over other frequency ranges.

Figure 3:
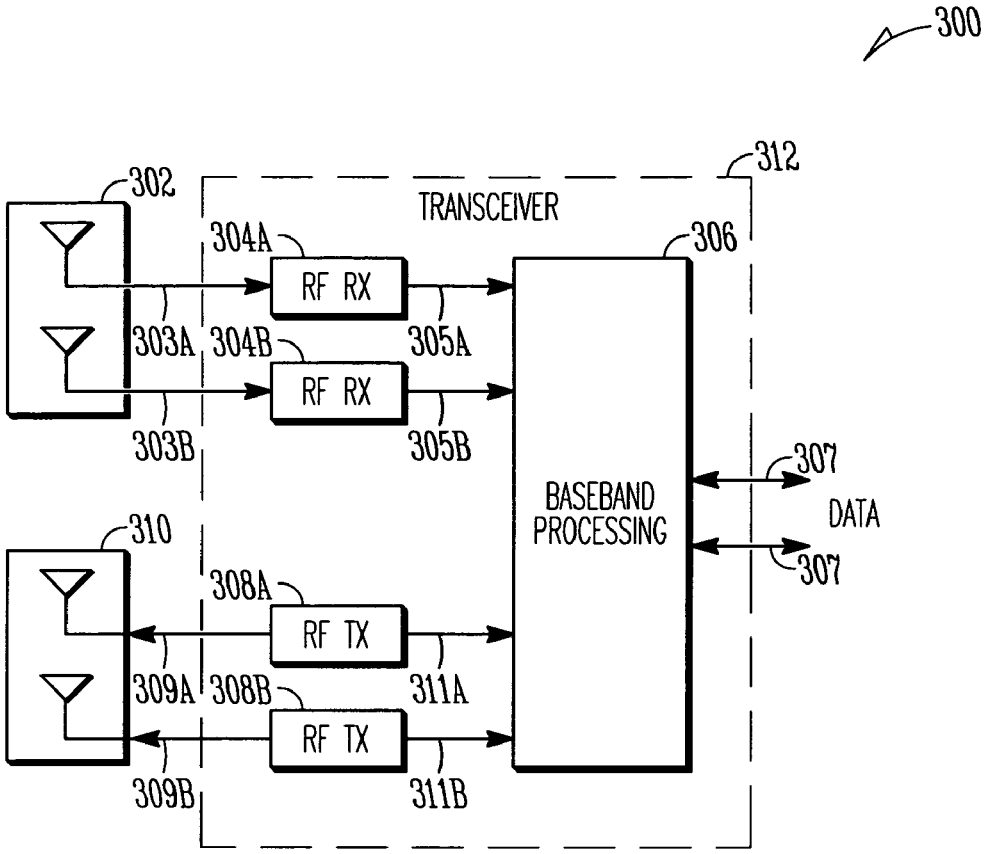
FIG. 3 illustrates a block diagram of a multiple-input multiple-output (MIMO) communication system in accordance with embodiments of the present invention.

FIG. 3 illustrates a block diagram of a multiple-input multiple-output (MIMO) communication station in accordance with embodiments of the present invention. MIMO communication station 300 includes transceiver 312, antenna structure 302 for receiving communication signals and antenna structure 310 for transmitting communication signals. Antenna structure 100 (FIG. 1A) may be suitable for use as antenna structure 302 and/or antenna structure 310, although the scope of the invention is not limited in this respect.

In some embodiments, transceiver 312 may comprise radio-frequency (RF) transmitter (TX) circuitry 308A and 309B to generate first and second first and second communication signals 309A and 309B respectively from first and second baseband signals 311A and 311B. In these embodiments, transceiver 312 may also comprise baseband processing circuitry 306 to generate first and second transmit baseband signals 311A and 311B from one or more data streams 307 for concurrent transmission.

In some embodiments, transceiver 312 may comprise RF receiver (RX) circuitry 304A and 304B to receive communication signals from antenna structure 302 and generate first and second received baseband signals 305A and 305B respectively from the received first and second multicarrier communication signals 303A and 303B. In some of these embodiments, baseband processing circuitry 306 may weight and combine components of first and second received baseband signals 305A and 305B (e.g., in the frequency-domain) to generate one or more output data streams 307, although the scope of the invention is not limited in this respect.

Although communication station 300 is illustrated as having several separate functional elements, one or more of the functional elements may be combined and may be implemented by combinations of software-configured elements, such as processing elements including digital signal processors (DSPs), and/or other hardware elements. For example, some elements may comprise one or more microprocessors, DSPs, application specific integrated circuits (ASICs), and combinations of various hardware and logic circuitry for performing at least the functions described herein. In some embodiments, the functional elements of station 300 may refer to one or more processes operating on one or more processing elements.

In some embodiments, multicarrier transceiver 312 may be part of a wireless communication device that may transmit multicarrier signals, such as orthogonal frequency division multiplexed (OFDM) communication signals. In some embodiments, multicarrier transceiver 312 may communicate over a multicarrier communication channel. The multicarrier communication channel may be within a predetermined frequency spectrum and may comprise a plurality of orthogonal subcarriers. In some embodiments, the orthogonal subcarriers may be closely spaced OFDM subcarriers. To help achieve orthogonality between the closely spaced subcarriers, each subcarrier may have a null at substantially a center frequency of the other subcarriers. In some embodiments, to help achieve orthogonality between the closely spaced subcarriers, each subcarrier may have an integer number of cycles within a symbol period, although the scope of the invention is not limited in this respect.

In some embodiments, the frequency spectrums for a multicarrier communication signal may comprise either a 5 GHz frequency spectrum or a 2.4 GHz frequency spectrum. In these embodiments, the 5 GHz frequency spectrum may include frequencies ranging from approximately 4.9 to 5.9 GHz, and the 2.4 GHz spectrum may include frequencies ranging from approximately 2.3 to 2.5 GHz, although the scope of the invention is not limited in this respect as other frequency spectrums are also equally suitable. In some broadband and WiMax embodiments, the frequency spectrum for communications may comprise frequencies between 2 and 11 GHz, although the scope of the invention is not limited in this respect.

In some embodiments, multicarrier transceiver 312 may communicate in accordance with specific communication standards, such as the Institute of Electrical and Electronics Engineers (IEEE) standards including IEEE 802.11(a), 802.11(b), 802.11(g), 802.11 (h) and/or 802.11 (n) standards for wireless local area networks (WLANs), although multicarrier transceiver 312 may also be suitable to transmit and/or receive communications in accordance with other techniques including the Digital Video Broadcasting Terrestrial (DVB-T) broadcasting standard, and the High performance radio Local Area Network (HiperLAN) standard. In some broadband and WiMax embodiments, multicarrier transceiver 312 may communicate broadband wireless communications in accordance with the IEEE 802.16(e) standards for wireless metropolitan area networks (WMANs).

In some embodiments, multicarrier transceiver 312 may be part of a wireless communication device, such as personal digital assistant (PDA), a laptop or portable computer with wireless communication capability, a web tablet, a wireless telephone, a wireless headset, a pager, an instant messaging device, a digital camera, an access point, television or other device that may receive and/or transmit information wirelessly. In some broadband and WiMax embodiments, multicarrier transceiver 312 may be part of a multicarrier communication station.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims.

In the foregoing detailed description, various features are occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, invention may lie in less than all features of a single disclosed embodiment. Thus the following claims are hereby incorporated into the detailed description, with each claim standing on its own as a separate preferred embodiment.

What is claimed is:

1. A two-port antenna structure comprising:

first and second radiating elements disposed on a first side of an insulating material;

third and fourth radiating elements disposed on a second side of the insulating material;

a first port crossover line coupled with the second radiating element and extending across a center region of the structure, the first port crossover line to couple a first communication signal to the second radiating element; and a second port crossover line coupled with the fourth radiating element and extending across the center region of the structure, the second port crossover line to couple a second communication signal to the fourth radiating element.

2. The antenna structure of claim 1 wherein a first conductor of a first signal input extends through the insulating material to couple with the first port crossover line, and a second conductor of the first signal input couples with the third radiating element, and wherein a first conductor of a second signal input extends through the insulating material to couple with the first radiating element and a second conductor of the second signal input couples with the second port crossover line.

3. The antenna structure of claim 2 wherein the first signal input is to couple the first communication signal, wherein the second signal input is to couple the second communication signal, and wherein the first and second communication signals are distinct communication signals for either transmission or reception by a multiple-input multiple-output communication station.

4. The antenna structure of claim 2 wherein the first signal input comprises a first coaxial cable input, the first conductor of the first signal input is a first center conductor and the second conductor of the first signal input is a first ground path conductor, and wherein the second signal input comprises a second coaxial cable input, the first conductor of the second signal input is a second center conductor and the second conductor of the second signal input is a second ground path conductor.

5. The antenna structure of claim 4 wherein the insulating material comprises a printed circuit board.

6. The antenna structure of claim 1 wherein the second and third radiating elements are oppositely positioned with respect to each other for communicating the first communication signal, and wherein the first and fourth radiating elements are oppositely positioned with respect to each other for communicating the second communication signal.

7. The antenna structure of claim 1 wherein signals communicated by the second and third radiating elements have a first polarization and signals communicated by the first and fourth radiating elements have a second polarization.

8. The antenna structure of claim 1 wherein the first port crossover line extends diagonally on the first side across the center region of the structure, and wherein the second port crossover line extends diagonally on the second side across the center region of the structure.

9. The antenna structure of claim 8 wherein the first and second port crossover lines comprise microstrip lines.

10. The antenna structure of claim 1 wherein the first port crossover line is disposed on the first side of the insulating material, and wherein the second port crossover line is disposed on the second side of the insulating material.

11. An antenna structure comprising:

a first port crossover line disposed on a first side of insulating material extending across a center region of the structure to couple with a second radiating element; and a second port crossover line disposed on a second side of the insulating substrate extending across the center region of the structure to couple with a fourth radiating element, wherein a first conductor of a first signal input extends through the insulating material to couple with the first port crossover line and a second conductor of the first signal input couples with a third radiating element, and wherein a first conductor of a second signal input extends through the insulating material to couple with a first radiating element and a second conductor of the second signal input couples with the second port crossover line.

12. The antenna structure of claim 11 wherein the first and second radiating elements are disposed on the first side of the insulating material, wherein the third and fourth radiating elements are disposed on the second side of the insulating material, and wherein the first, second, third and fourth radiating elements are further disposed on the insulating material in quadrature positions about the center region.

13. The antenna structure of claim 12 wherein the second and third radiating elements communicate first communication signals having a first polarization, and wherein first and fourth radiating elements communicate second communication signals having a second polarization.

14. The antenna structure of claim 12 wherein the first signal input comprises a first coaxial cable, the first conductor of the first signal input is a first center conductor and the second conductor of the first signal input is a first ground path conductor, wherein the second signal input comprises a second coaxial cable, the first conductor of the second signal input is a second center conductor and the second conductor of the second signal input is a second ground path conductor, and wherein the insulating material comprises a printed circuit board.

15. The antenna structure of claim 14 wherein the antenna structure comprises a two-signal input antenna structure for use in a multiple-input multiple-output multicarrier communication system, wherein the second and third radiating elements communicate a first multicarrier communication signal, wherein the first and fourth radiating elements communicate a second multicarrier communication signal, wherein the multicarrier communication signals comprise orthogonal frequency division multiplexed signals comprising a plurality of orthogonal subcarriers, and wherein the subcarriers of each communication signal have an integer number of cycles within a symbol period to achieve orthogonality therebetween.

16. A multiple-input multiple-output communication station comprising:

an antenna structure to transmit first and second multicarrier communication signals; and a multicarrier transceiver comprising radio-frequency transmitter circuitry to generate the first and second first and second multicarrier communication signals respectively from first and second transmit baseband signals, wherein the antenna structure comprises:

first and second radiating elements disposed on a first side of an insulating material;

third and fourth radiating elements disposed on a second side of the insulating material;

a first port crossover line coupled with the second radiating element and extending across a center region of the structure, the first port crossover line to couple the first multicarrier communication signal to the second radiating element; and a second port crossover line coupled with the fourth radiating element and extending across the center region of the structure, the second port crossover line to couple the second multicarrier communication signal to the fourth radiating element.

17. The station of claim 16 wherein the multicarrier transceiver further comprises baseband processing circuitry to generate the first and second transmit baseband signals from one or more data streams for concurrent transmission.

18. The station of claim 17 wherein the antenna structure is a first antenna structure, and wherein the multicarrier transceiver further comprises:

a second antenna structure to receive first and second multicarrier communication signals; and RF receiver circuitry to receive multicarrier communication signals from the second antenna structure and generate first and second received baseband signals respectively from the received first and second multicarrier communication signals, wherein the baseband processing circuitry is to weight and combine components of first and second received baseband signals to generate one or more output data streams.

19. The station of claim 18 wherein the multicarrier communication signals comprise orthogonal frequency division multiplexed signals comprising a plurality of orthogonal subcarriers, wherein the subcarriers of each communication signal have an integer number of cycles within a symbol period to achieve orthogonality therebetween.

20. The station of claim 16 wherein a first conductor of a first signal input extends through the insulating material to couple with the first port crossover line, and a second conductor of the first signal input couples with the third radiating element, and wherein a first conductor of a second signal input extends through the insulating material to couple with the first radiating element and a second conductor of the second signal input couples with the second port crossover line.

21. The station of claim 20 wherein the first signal input comprises a first coaxial cable input, the first conductor of the first signal input being a first center conductor and the second conductor of the first signal input being a first ground path conductor, and wherein the second signal input comprises a second coaxial cable input, the first conductor of the second signal input being a second center conductor and the second conductor of the second signal input being a second ground path conductor.

22. A method for communicating two communication signals comprising:

transmitting a first communication signal with second and third oppositely positioned radiating elements of an antenna structure;

transmitting a second communication signal with first and fourth oppositely positioned radiating elements of the antenna structure;

coupling the first communication signal to the second radiating element with a first port crossover line disposed on a first side of an insulating material; and coupling the second communication signal to the fourth radiating element with a second port crossover line disposed on a second side of the insulating material, wherein the first and second radiating elements are disposed on the first side, and wherein the third and fourth radiating elements are disposed on the second side.

23. The method of claim 22 wherein the first and second communication signals are transmitted concurrently and comprise a single orthogonal frequency division multiplexed symbol.

24. The method of claim 22 wherein a first conductor of a first signal input extends through the insulating material to couple with the first port crossover line, and a second conductor of the first signal input couples with the third radiating element, wherein a first conductor of a second signal input extends through the insulating material to couple with the first radiating element and a second conductor of the second signal input couples with the second port crossover line, and wherein the first and second communication signals are distinct communication signals for either transmission or reception by a multiple-input multiple-output communication station.

25. A system comprising:

an antenna structure; and first and second coaxial connectors to couple, respectively, first and second communication signals to the antenna structure, wherein the antenna structure comprises:

first and second radiating elements disposed on a first side of an insulating material;

third and fourth radiating elements disposed on a second side of the insulating material;

a first port crossover line disposed on the first side coupled with the second radiating element and extending across a center region of the structure, the first port crossover line to couple the first communication signal to the second radiating element; and a second port crossover line disposed on the second side coupled with the fourth radiating element and extending across the center region of the structure, the second port crossover line to couple the second communication signal to the fourth radiating element.

26. The system of claim 25 wherein a first conductor of a first signal input extends through the insulating material to couple with the first port crossover line, and a second conductor of the first signal input couples with the third radiating element, and wherein a first conductor of a second signal input extends through the insulating material to couple with the first radiating element and a second conductor of the second signal input couples with the second port crossover line.

27. The system of claim 26 wherein the first signal input comprises a first coaxial cable input, the first conductor of the first signal input being a first center conductor and the second conductor of the first signal input being a first ground path conductor, and wherein the second signal input comprises a second coaxial cable input, the first conductor of the second signal input being a second center conductor and the second conductor of the second signal input being a second ground path conductor.

* * * * *